United States Patent [19]

Ogita et al.

[11] Patent Number: 4,705,386

[45] Date of Patent: Nov. 10, 1987

[54] COLOR COPYING MACHINE

[75] Inventors: Akira Ogita, Sagamihara; Masaaki Tanaka, Yokohama, both of Japan

[73] Assignees: Shinko Electric Co., Ltd.; Fuji Xerox Co., Ltd., both of Tokyo, Japan

[21] Appl. No.: 862,017

[22] Filed: May 12, 1986

[51] Int. Cl.[4] ..... G03G 15/01

[52] U.S. Cl. ..... 355/4; 355/14 TR; 355/14 SH

[58] Field of Search ..... 355/4, 14 TR, 14 SH, 355/14 R, 14 C

[56] References Cited

U.S. PATENT DOCUMENTS

| | | | |
|---|---|---|---|
| 4,025,182 | 5/1977 | Goel | 355/4 |
| 4,194,829 | 3/1980 | Cavagnaro | 355/14 SH X |
| 4,416,534 | 11/1983 | Kluger | 355/14 SH |
| 4,537,493 | 8/1985 | Russel | 355/4 X |

FOREIGN PATENT DOCUMENTS

| | | | |
|---|---|---|---|
| 58-68058 | 4/1983 | Japan . | |
| 59-8137 | 2/1984 | Japan . | |
| 60-218673 | 11/1985 | Japan | 355/4 |

*Primary Examiner*—Arthur T. Grimley
*Assistant Examiner*—J. Pendegrass
*Attorney, Agent, or Firm*—Welsh & Katz, Ltd.

[57] ABSTRACT

A color copying machine includes scanning device for applying illumination onto a color original to effect a scanning operation. A color separator includes a plurality of optical filters of different colors, each of the filters allowing a predetermined light component of the illumination to pass therethrough during each scanning operation so as to apply it onto a photoconductive drum charged uniformly to form an electrostatic image thereon. Color toner is applied to each of the electrostatic images during the rotation of the photoconductive drum. The toner image on the photoconductive drum is transferred to a record sheet on a transfer drum. Two sensors are provided for sensing the initiation of each scanning operation and the position of the record sheet on the transfer drum. A control circuit detects, in response to the outputs of the two sensors, start and end timings of the transferring of each of the toner images onto the record sheet. The control circuit controls the transfer drum to rotate at the same speed as the photoconductive drum during the transfer of each toner image to said record sheet, and controls the transfer drum to rotate, during a time interval between the two consecutive transfer operations, at such a speed that a leading edge of the record sheet on the transfer drum is brought into agreement with a leading edge of each toner image on the photoconductive drum.

4 Claims, 9 Drawing Figures

COLOR COPYING MACHINE

BACKGROUND OF THE INVENTION

1. Field of the Invention

This invention relates to a color copying machine or electrophotographic copier.

2. Prior Art

A conventional color copying machine shown in FIG. 1 comprises a charging system, a scan-exposure system, a developing system, a transfer system, a paper feed system and a fusing-exit system. More specifically, the scan-exposure system comprises a platen 1, a lamp 2, reflection mirrors 30 to 35, lens 4, and a color separator 5 having three filters of blue, green and red. The developing system comprises a photoconductive drum 6, three developing devices 7, 8 and 9 containing toners of yellow, magenta and cyan, respectively. The transfer system comprises a transfer drum 11 having a gripper 10 for holding a record sheet of paper on the transfer drum 11, and a transfer corotoron 12 mounted in the transfer drum 11. The paper feed system comprises trays 13 and 14 for holding record sheets of paper of different sizes, respectively, and paper feed rollers 15. The fusing-exit system comprises an endless belt 16, fuser rollers 17, exit rollers 18 and an exit tray 19.

FIG. 2 shows a timing chart for the sequential operation of the copying machine. For copying a color original placed on the platen 1, the photoconductive drum 6 is charged uniformly, and the original is illuminated by scanning through the high-intensity lamp 2 and projected to the photoconductive drum 6 through the blue filter of the color separator 5 to form an electrostatic image (FIG. 2*a*) thereon. Then, the yellow toner (Y) is attracted by this electrostatic image to develop it (FIG. 2*b*). Then, the developed toner image is transferred to the paper on the transfer drum 11 (FIG. 2*c*). According to the same procedure, the second (green filter) and third (red filter) scannings are sequentially effected, so that a second image of magenta toner (M) and a third image of cyan toner (C) are transferred onto the paper on the transfer drum 11. Finally, the toner image is fixed to the paper by the fuser rollers 17.

As shown in FIG. 2, the scanning starts at time $t_0$, and at time $t_1$ the leading edge of the original image on the photoconductive drum 6 reaches a transfer point T where the photoconductive drum 6 and the transfer drum 11 are held in contact with each other (FIG. 2-(*b*)). The transfer drum 11 is rotated at the same peripheral speed as the photoconductive drum 6 when the above scanning starts, and the record sheet of a selected size is fed from the paper feed system and is held around the transfer drum 11 by the gripper 10. At time $t_1$, the leading edge of the record sheet also reaches the transfer position T (FIG. 2-(*c*)), and then as the photoconductive drum 6 and transfer drum 11 are continued to be rotated at the same peripheral speed, so that the yellow toner image is transferred to the record sheet. Then, according to the same procedure, the magenta and cyan toner images are sequentially transferred to the record sheet. And the toner images are fixed by the fuser 17, so that the full color image is produced on the sheet.

In FIG. 2, character L designates amounts corresponding to the peripheral length of each of the photoconductive and transfer drums 6 and 11. The returning of the scan system (the leftward movement of the lamp 2 in FIG. 1) to its initial position after the scanning operation is hereinafter referred to as "scanning-back".

Since the yellow, magenta and cyan toner images are sequentially transferred onto the single record sheet to achieve a color copying, each toner image must be transferred accurately to the same position on the record sheet to achieve a copying of good quality. This requires that drive mechanisms for the scan system, the photoconductive drum 6 and the transfer drum 11 must be operated in synchronism with one another. In view of this, the photoconductive drum 6 and the transfer drum 11 are connected together through a gearing with little backlash so that they are rotated together with each other. And, the drive mechanism for the scan system comprises a servomotor which has a high responsiveness in speed control. With such drive system, the peripheral length L of the transfer drum 11 is so determined that one set of scanning and scanning-back with respect to a record sheet of the maximum size, i. e., A3-size, is effected per one revolution of the transfer drum. Alternatively, the peripheral length L is equal to the length of A-3 size record sheet. Since the transfer drum 11 is rotated at a constant peripheral speed which is equal to that of the photoconductive drum 6, in the former case, the copyings on B5-size to A3-size sheets require the same time whereas in the latter case, the copying on A3-size sheet requires time almost twice as long as that for the copying on B5-size or A4-size sheet since the transfer drum 11 has to be idled one revolution when the lamp 2 is returned to its initial position for the next scanning.

SUMMARY OF THE INVENTION

It is therefore an object of this invention to provide a color copying machine capable of suitably varying the time required for the copying depending on the size of a record sheet of paper.

According to the present invention, there is provided a color copying machine which comprises a color copying machine comprising scanning means for applying illumination onto a color original to effect a scanning operation; a photoconductive drum operable to rotate at a constant speed; means for charging the photoconductive drum; color separating means including a plurality of optical filters of different colors, each of the filters allowing a predetermined light component of the illumination to pass therethrough during each scanning operation so as to apply it onto the photoconductive drum to form an electrostatic image thereon; developing means for applying toner to the electrostatic image during the rotation of the photoconductive drum to form a toner image; a transfer drum rotatable at a variable speed, the transfer drum being adapted to hold a record sheet therearound, the toner image on the photoconductive drum being sequentially transferred to the record sheet to form a color image on the record sheet; first sensor means for sensing the initiation of each scanning operation to feed a first sensing signal; second sensor means for sensing the position of the record sheet on the transfer drum to feed a second sensing signal; and control means responsive to the first and second sensing signals for detecting start and end timings of the transfer operation and for controlling the transfer drum to rotate at the same speed as the photoconductive drum during the transfer process, the control means controlling the transfer drum to rotate during a time interval between the two consecutive transfer operations at such a speed that a leading edge of the record sheet on the transfer drum is brought into agreement with a leading edge of the original image on the photoconductive drum.

DESCRIPTION OF THE PREFERRED EMBODIMENT OF THE INVENTION

Figure 1:
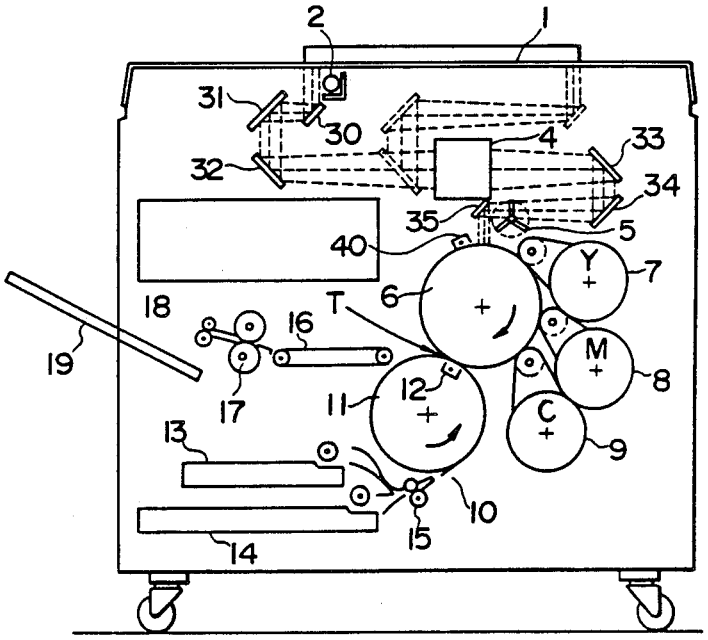
FIG. 1 (PRIOR ART)
FIG. 1 is a schematic view of a color copying machine provided in accordance with the prior art.
Figure 3:
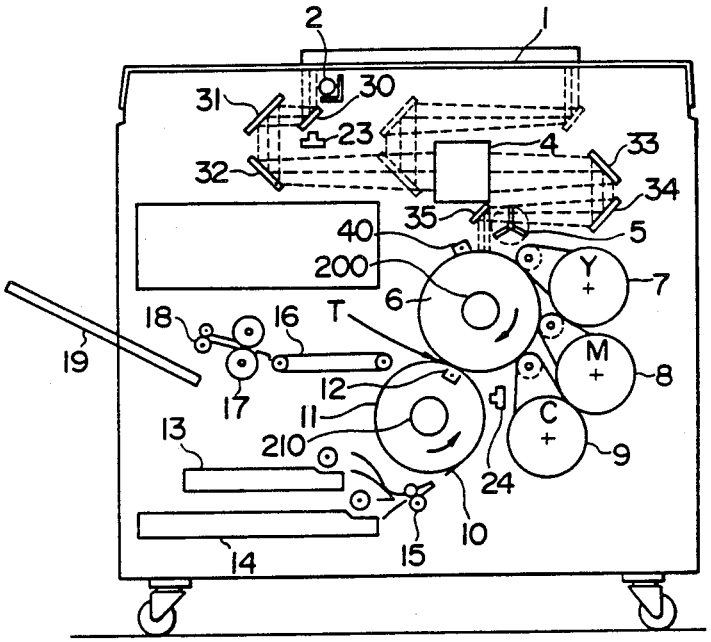
FIG. 3 is a schematic view of a color copying machine provided in accordance with the present invention.
Figure 4:
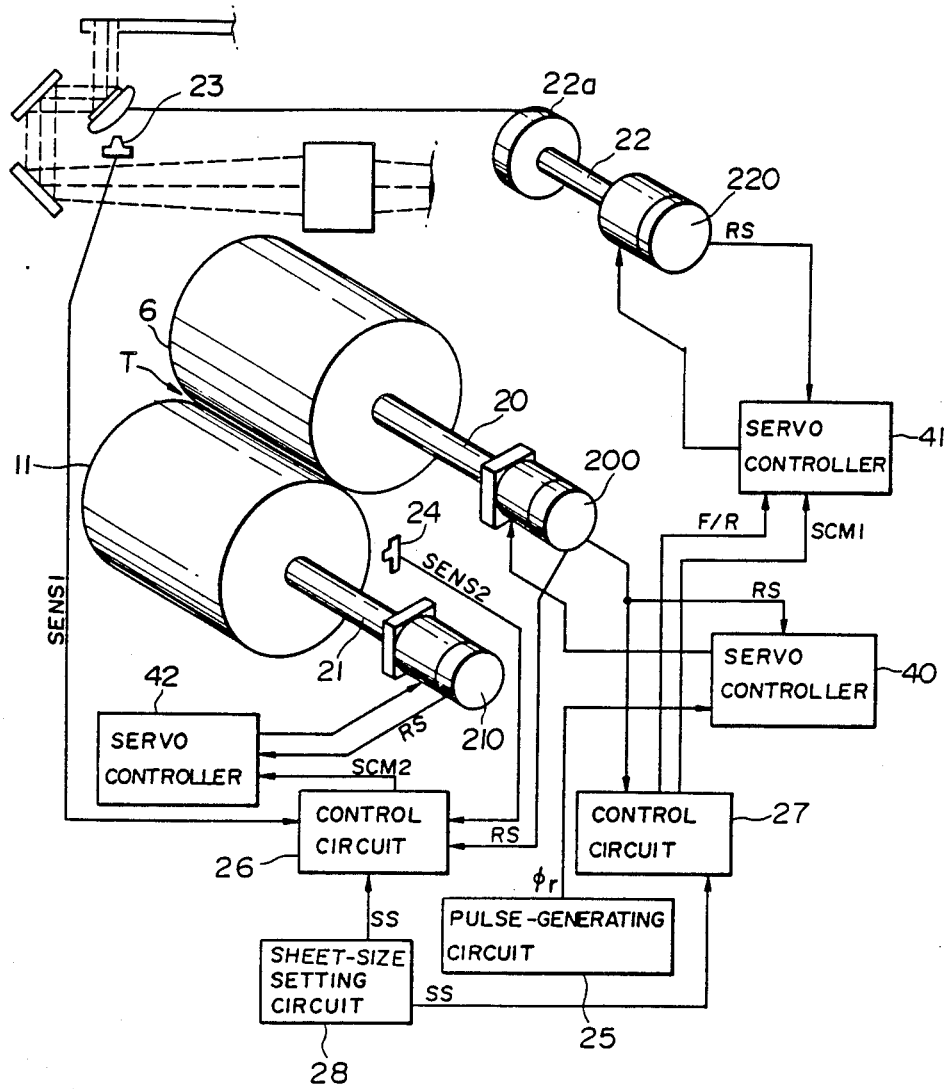
FIG. 4 is a schematic view of the copying machine of FIG. 3, showing a drive and control system thereof.

A color copying machine shown in FIGS. 3 and 4 is generally similar in construction to the copying machine of FIG. 1. Therefore, corresponding parts are designated by like reference characters, and detailed description thereof is omitted. The color copying machine comprises a photoconductive drum 6 having an integral shaft 20, a transfer drum 11 having an integral shaft 21, a capstan *22a* having an integral shaft 22, and three servomotors 200, 210 and 220 which are connected in driving relation to the shafts 20, 21 and 22, respectively, the servomotor 220 being of the reversible type. Each of the servomotors 200, 210 and 220 is provided with a rotary encoder for outputting a pulse train (rotation signal RS) whose pulse rate is proportional to the rotation of the output shaft of the corresponding servomotor. A peripheral length of the transfer drum 11 is set to a value equal to the summation of the length of a record sheet of the maximum size and the peripheral length of the drum 6 corresponding to the angular movement during a scanning-back. The capstan *22a* is operatively connected to the scan system, including an elongated high-intensity lamp 2, for moving it so as to effect a scanning operation. When the servomotor 220 is rotated in the normal direction, the scan system is driven in the forward direction for effecting a scanning, while when the motor 220 is rotated in the reverse direction, the scan system is driven in the reverse direction to effect the scanning-back. A first photosensor 23 for detecting the initiation of the scanning is located in the vicinity of an inoperative or rest position of the lamp 2, and a second photosensor 24 for detecting the trailing edge of the record sheet is located adjacent to a transfer point T where the photoconductive drum 6 and the transfer drum 11 are held in contact with each other through a record sheet.

Figure 5:
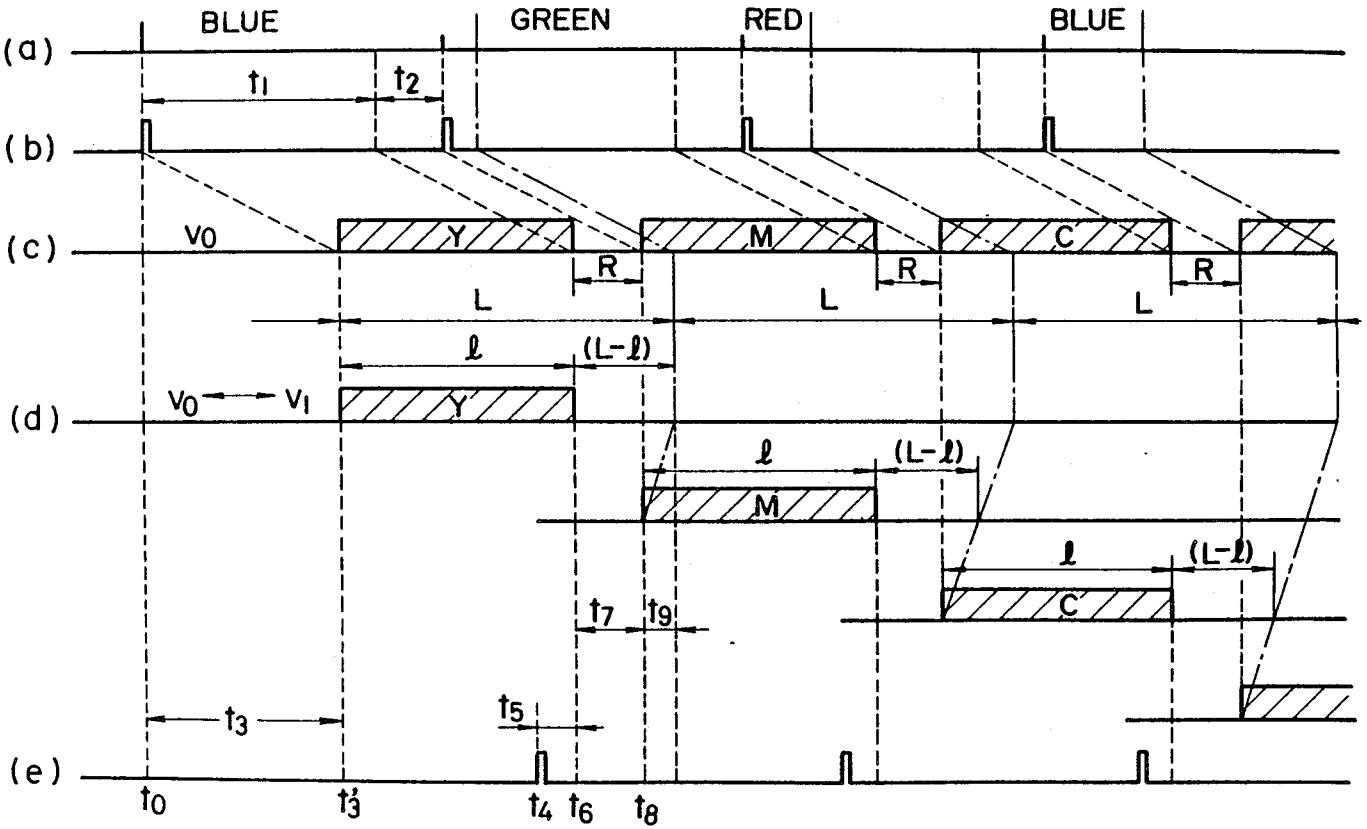
FIG. 5 is a timing chart illustrating the sequential operation of the copying machine of FIG. 3.

Control means comprises a pulse-generating circuit 25 for outputting a reference pulse signal $\phi r$, a first control circuit 26 for controlling the operation of the servomotor 210, a second control circuit 27 for controlling the operation of the servomotor 220, and a sheet size-setting circuit 28. FIGS. 5-(*a*) to 5-(*e*)- diagrammatically show sequential operations of the scan system, the photosensor 23, the photoconductive drum 6, the transfer drum 11 and the photosensor 24, respectively. Characters L, l and R correspond respectively to the entire peripheral length of each of the photoconductive drum 6 and transfer drum 11, the length of the record sheet, and the peripheral length of the drum 6 corresponding to the angular movement during the scanning-back.

The control means shown in FIG. 4 will now be more fully described.

Figure 6:
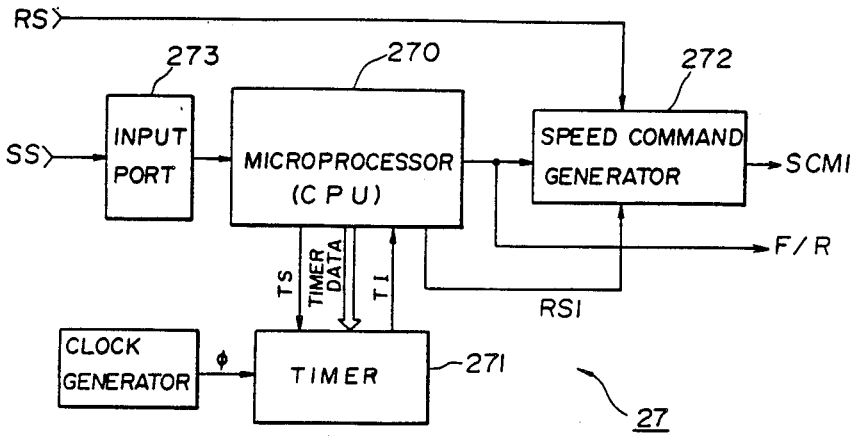
FIG. 6 is a circuit diagram of the control circuit 27 of the copying machine of FIG. 4.

First, the sheet size-setting circuit 28 is set to produce a signal SS representative of the size of the sheet to be used (size signal). This size signal SS is fed to the first and second control circuits 26 and 27. It is assumed that a record sheet of a smaller size is now selected. When the recording or copying is started through suitable switch means (not shown), the pulse-generating circuit 25 begins to feed the reference pulse signal $\phi r$ to a servo controller 40 which is connected to the servomotor 200. The servo controller 40 is so constructed that it counts up the pulse signal $\phi r$ and counts down the signal RS representative of the rotation speed of the servomotor 200 and that it drives the motor 200 in such a manner that the count value of the both pulses is always zero. As a result, the photoconductive drum 6 is rotated at a constant peripheral speed determined by the reference clock pulse signal $\phi r$. Next, the photoconductive drum 6 is charged uniformly by a charging corotoron 40. The rotation signal RS outputted from the servomotor 200 is also supplied to the second control circuit 27. As shown in FIG. 6, the control circuit 27 comprises a microprocessor (CPU) 270, a timer 271 and a speed command generator 272.

Figure 7:
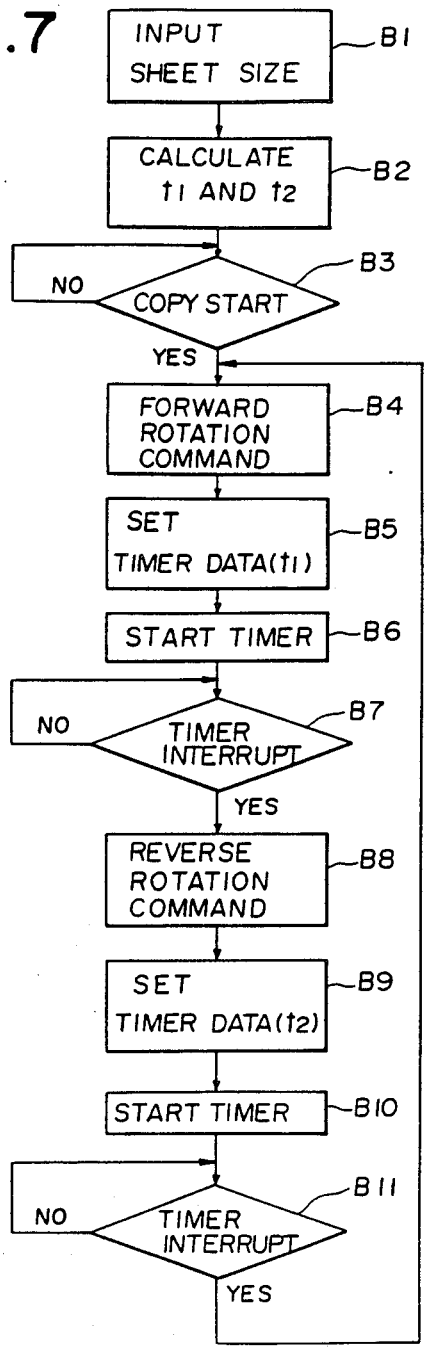
FIG. 7 is is a flow chart of the processing performed by the CPU 270 of FIG. 6.

The control circuit 27 will now be more fully described with reference to the time chart of FIG. 5 and a flow chart of FIG. 7.

Figure 2:
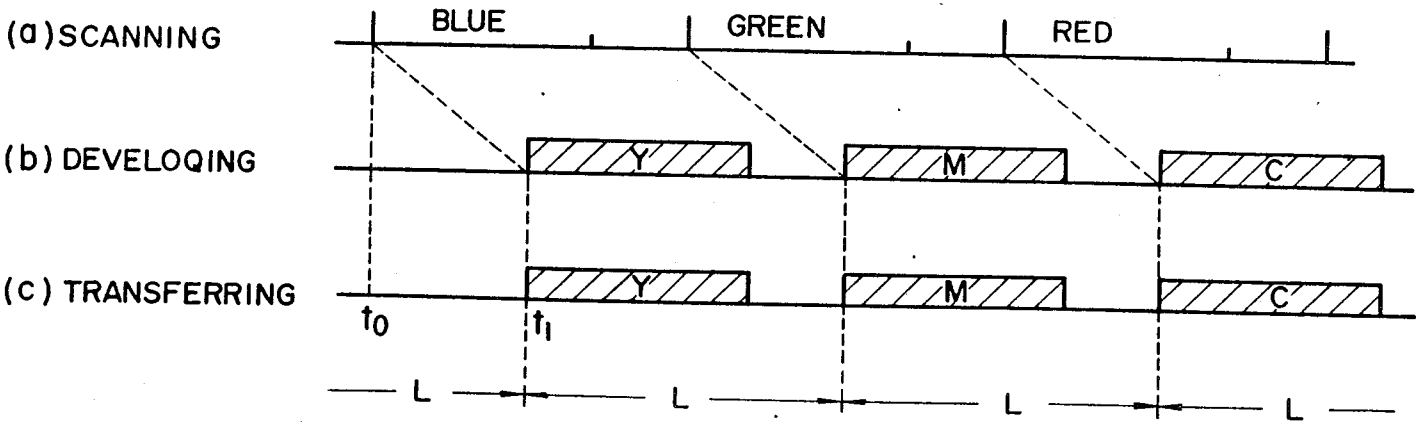
FIG. 2 (PRIOR ART)
FIG. 2 is a timing chart illustrating the sequential operation of the copying machine of FIG. 1.

When the CPU 270 is supplied with the size signal SS from the sheet-size setting circuit 28 through an input port 273 (see block B1 of FIG. 7), it calculates time period $t_1$ which is the time period necessary to scan the original placed on the platen 1 at a speed corresponding to the rotation speed of the drum 6. The CPU 270 also calculates time period $t_2$ which is the time period necessary to return the scanning unit to its home position at a predetermined speed (block B2). At block B3, the CPU 270 determines whether the copy start signal (not shown) has been supplied thereto. If the determination of this block is "YES", the CPU 270 outputs a direction signal F/R in "1" state to the speed command generator 272 and a servo controller 41 (block B4), and then outputs data representative of the time period $t_1$ and a timer start signal TS to the timer 271 (blocks B5 and B6). The direction signal F/R is "1" when the motor 220 is to be rotated in the normal direction and is "0" when the motor 220 is to be rotated in the reverse direction. The speed command generator 272 outputs the rotation signal RS from the motor 200 as a speed command signal SCM1 to the servo controller 41 when the signal F/R in the "1" state is supplied, and outputs a pulse train RS1 corresponding to the predetermined return speed of the scanning system as the speed command signal SCM1 when the signal F/R in the "0" state is supplied, the pulse train RS1 being produced by the CPU 270. The servo controller 41 is substantially identical in construction to the servo controller 40 and differs therefrom only in that the direction of the count operation is changed in accordance with the signal F/R. And therefore, if the CPU 270 begins to output the signal F/R in the "1" state at time $t_0$ (see FIG. 5), the scan system including the lamp 2 is operated to scan a color original on the platen 1 during a time period $t_1$. On the other hand, the timer 271 is so constructed that it outputs a timer interrupt signal TI when the time period represented by the data stored thereinto has lapsed. The CPU 270 determines at block B7 of FIG. 7 whether the signal TI is outputted from the timer 271. When the determination at the block B7 becomes "YES", the CPU 270 changes the state of the signal F/R from "1" to "0" (block B8) and also stores data representative of the time period $t_2$ into the timer 271 (block B9). The CPU 270 also outputs the signal TS to the timer 271 (block B10). As a result, the servomotor 220 is rotated in its reverse direction to return the scan system to its initial or rest position at the predetermined speed during the time period $t_2$ to effect the scanning-back. When the time period $t_2$ has lapsed, the CPU 270 detects this at block B11 and initiates another scanning at block B4. The second control circuit 27 is also so constructed as to effect the above procedure three times as described above for FIGS. 1 and 2, so that the peripheral surface of the photoconductive drum 6 is sequentially exposed to the three light components of the illumination passing respectively through the blue, green and red filters of the color separator 5 to thereby form an electrostatic image thereon (FIG. 5-(*a*)).

In this case, one scanning operation is not carried out per revolution of the photoconductive drum 6. In other words, after one scanning operation is completed, the next scanning operation starts as soon as the scanning-back is done. The first photosensor 23 is a sensor of the photo-interrupt type to detect the start of each scanning operation and to feed a detection signal SENS1 (FIG. 5-(*b*)) to the first control circuit 26.

As described above, each of the three electrostatic images is developed by a corresponding color toner when passing a respective one of developing devices 7, 8 and 9. After a time period $t_3$ from the time $t_0$, the leading edge of the original image developed by the yellow toner on the photoconductive drum 6 reaches, at time $t_3'$, the transfer position T where the photoconductive drum 6 is in contact with the transfer drum 11 through a record sheet (FIG. 5-(*c*)). The control circuit 26 is so arranged that it begins to output a speed command signal SCM2 to a servo controller 42 to rotate the servomotor 210 at a constant speed determined by the rotation signal RS from the servomotor 200 in response to the detection signal SENS1 fed from the photosensor 23. As a result, the transfer drum 11 is rotated at the same peripheral speed as the photoconductive drum 6 and holds a record sheet, fed from the paper feed system, therearound with a gripper 10. The paper feed system is so designed that when the transfer drum 11 is rotated at the same speed as the photoconductive drum 6 the leading edge of the record sheet and that of the corresponding electrostatic image reach the transfer position T simultaneously. And therefore, when the leading edge of the record sheet reaches the transfer position T at the time $t_3'$, these two leading edges are brought into agreement with each other (FIG. 5-(*d*)). Then, the transfer of the yellow toner image from the photoconductive drum 6 to the surface of the record sheet is effected. This transfer is completed at time $t_6$ when the trailing edge of the record sheet reaches the transfer position T, that is to say, the transfer drum 11 is rotated or angularly moved by an amount corresponding to the length l of the record sheet. At time $t_4$ immediately before the time $t_6$, the second photosensor 24, located upstream of the transfer point T, detects the trailing edge of the record sheet to feed a detection signal SENS2 to the control circuit 26 (FIG. 5-(*e*)). The first control circuit 26 is also so constructed that it measures, in response to this detection signal SENS2, time period $t_5$ to be lapsed until the trailing edge of the record sheet reaches the transfer point T at the time $t_6$ and that it calculates the speed $v_1$ at which the transfer drum 11 is to be rotated from the time $t_6$. This speed $v_1$ is of such a level that the leading edge of the record sheet again reaches the transfer point T at the time when the leading edge of the next original image on the drum 6 reaches the transfer point T. More specifically, the control circuit 26 is responsive to the detection signal SENS2 from the photosensor 24 to change the pulse rated of a rotation command signal SCM2 to the servo controller 42 to drive the servomotor 210 at a higher speed from the time $t_6$, so that the leading edge of the record sheet is brought into agreement with the leading edge of the subsequently-developed original image of magenta toner on the photoconductive drum 6 at the transfer position T at time $t_8$ which is a time period $t_7$ after the time $t_6$. Thus, the transfer drum 11 is driven for rotation or angular movement at the higher speed during the time interval $t_7$. In other words, during the time period $t_7$ when the photoconductive drum 6 is angularly moved at the constant speed by an amount corresponding to a peripheral length R between the trailing edge of the yellow toner image and the leading edge of the magenta toner image, the transfer drum 11 is angularly moved at the higher speed by an amount corresponding to a peripheral length of (L - l) wherein L and l denote the peripheral length of the transfer drum 11 and the length of the record sheet, respectively, as mentioned above.

If the speeds of rotation of the photoconductive and transfer drums 6 and 11 during the time period $t_7$ are represented by $v_0$ and $v_1$, respectively, the following formula (1) is obtained:

$$\frac{R}{v_0} = \frac{(L - l)}{v_1} = t_7 \qquad (1)$$

Therefore, the rotation speed $v_1$ is obtained from the following formula (2):

$$v_1 = \frac{(L - l)}{R} v_0 \qquad (2)$$

The rotation speed $v_0$ of the photoconductive drum 6 and the peripheral length L thereof are predetermined, and the length l of the record sheet and the amount of rotation of the photoconductive drum 6 corresponding to the peripheral length R can be determined by the size signal SS from the sheet sizesetting circuit 28. Therefore, the control circuit 26 can obtain the above-described speed $v_1$, and the transfer drum 11 can be rotated by the servomotor 210 at the speed $v_1$ determined in accordance with the size of the record sheet under the control of the control circuit 26. The control circuit 26 is also so designed that it detects lapse of time equal in length to the time period $t_3$ from the time when the photosensor 23 outputs the detection signal SENS1 and that it changes the rotation speed of the drum 11 when the lapse of time is detected. More specifically, at the time $t_8$, the control circuit 26 is responsive to the detection signal SENS1 from the photosensor 23 to vary the speed of rotation of the transfer drum 11 from the higher speed $v_1$ to the normal speed $v_0$, so that the magenta toner image on the photoconductive drum 6 is transferred to the record sheet on the transfer drum 11 according to the procedure as described above for the transfer of the yellow toner image. Subsequently, the cyan toner image is transferred from the photoconductive drum 6 to the record sheet on the transfer drum 11 according to the same procedure.

The control circuit 26 will now be more fully described with reference to FIGS. 8 and 9.

Figure 8:
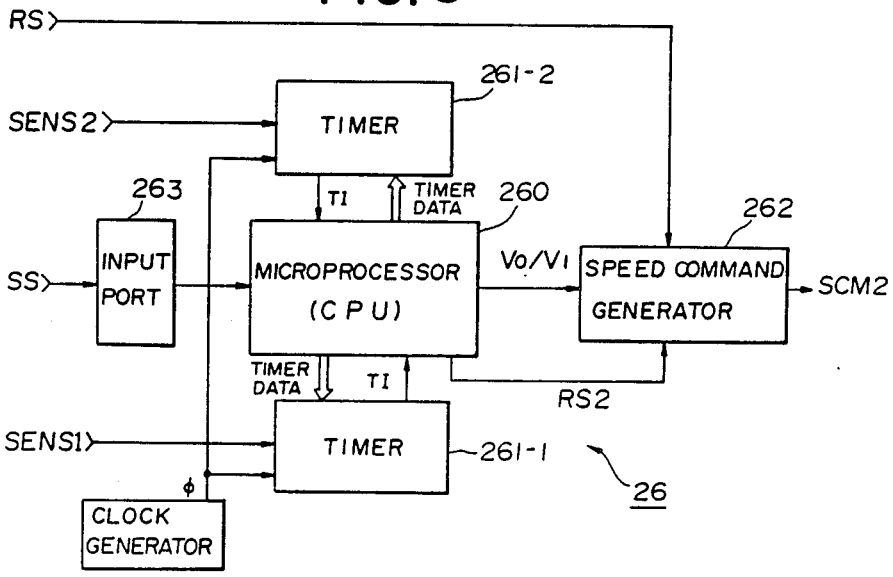
FIG. 8 is a circuit diagram of the control circuit 26 of the copying machine of FIG. 4.
Figure 9:
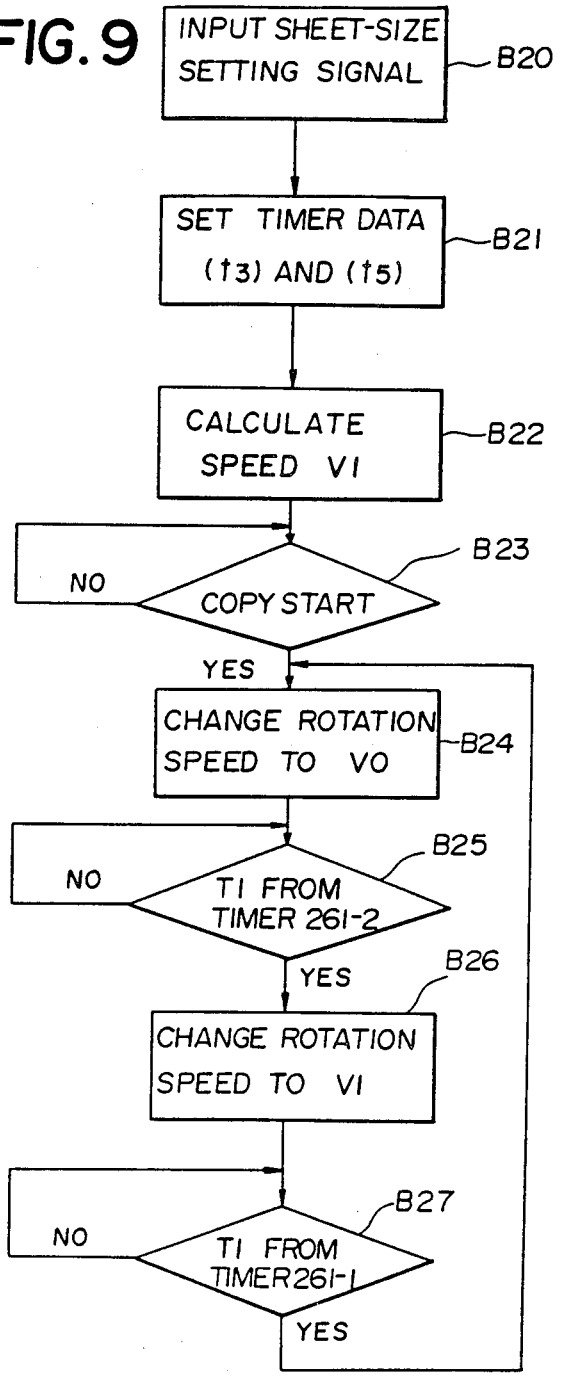
FIG. 9 is a flow chart of the processing performed by the CPU 260 of FIG. 8.

As shown in FIG. 8, the control circuit 26 comprises a CPU 260, timers 261-1 and 261-2 and a speed command generator 262. When the sheet-size signal SS is supplied to the CPU 260 through a input port 263 (see block B20 of FIG. 9), the CPU 260 obtains two data representative respectively of the time period $t_3$ and the time period $t_5$ and stores the two data respectively into the timer 261-1 and 261-2 (block B21). Then, the CPU 260 calculates the speed $v_1$ based on the above formula (2) and outputs a pulse train RS2 whose pulse rate corresponds to the rotation speed $v_1$ (block B22). In the initial condition, the CPU 260 outputs a signal V0/V1 in the state of "1" to cause the speed command generator 262 to output the pulse signal RS fed from the servomotor 200 to the servo controller 42 as the speed command signal SCM2 (block B24). The servo controller 42 is identical in construction to the servo controller 40. The timers 261-1 and 261-2 are identical in construction to the timer 271, and are triggered by the detection signals SENS1 and SENS2 fed from the photosensors 23 and 24, respectively. When the time period $t_5$ has lapsed from the time $t_4$, the CPU 260 receives a timer interrupt TI from the timer 261-2 (block B25). In response to this timer interrupt TI, the CPU 260 changes the state of the signal V0/V1 from "1" to "0", so that the speed command generator 262 outputs the signal RS2 from the CPU 260 as the speed command signal SCM2 to the servo controller 42 (block B26). As a result, the servomotor 210 begins to rotate at the speed $v_1$ from the time $t_6$. When the time period $t_3$ has lapsed from the generation of the detection signal SENS1 at the time $t_8$, the CPU 260 receives a timer interrupt TI from the timer 261-1 (block B27). In response to this timer interrupt TI, the CPU 260 returns the processing to the block B24, whereupon the state of the signal V0/V1 is changed from "0" to "1", so that the drum 11 begins to rotate at the speed $v_0$.

Thus, the yellow, magenta and cyan toner images sequentially transferred to the record sheet cooperate with one another to provide a desired color copying of the color original. As described above, with the copying machine according to the present invention, the time required for the two consecutive transfers of the toner images to the record sheet can be shortened by time $t_9$ shown in FIG. 5 as compared with the conventional copying machine, the time $t_9$ being represented as follows:

$$t_9 = \frac{L - l - R}{v_0}$$

In the above embodiment, the peripheral length of the transfer drum 11 is so determined that one set of scanning and scanning-back with respect to a record sheet of the maximum size, that is, one reciprocation of the lamp 2, is effected per one revolution of the transfer drum 11. Therefore, when a record sheet of the maximum size is used, the transfer drum 11 is rotated at the constant speed $v_0$ throughout the operation. And, when a record sheet of a smaller size is used, the transfer drum is selectively rotated at the higher speed $v_1$ during a time interval between the two consecutive transfers of the toner images as described above. Alternatively, the peripheral length of the transfer drum 11 may be so determined that one set of scanning and scanning-back with respect to a record sheet of the maximum size is not completed during one revolution of the transfer drum 11. In this case, the transfer drum 11 is selectively rotated at either higher or lower speed during a time interval between the two consecutive transfers of the toner images in accordance with the size of the record sheet selected.

What is claimed is:

1. A color copying machine comprising:

(a) scanning means for applying illumination onto a color original to effect a scanning operation;

(b) a photoconductive drum operable to rotate at a constant speed;

(c) means for charging said photoconductive drum uniformly;

(d) color separator means including a plurality of optical filters of different colors, each of said filters allowing a predetermined light component of said illumination to pass therethrough during each scanning operation so as to apply it onto said photoconductive drum to form an electrostatic original image thereon;

(e) developing means for applying color toner to said electrostatic original image to form a developed original image;

(f) a transfer drum rotatable at a variable speed, said transfer drum being adapted to hold a record sheet therearound, said developed original image on said photoconductive drum being transferred to said record sheet;

(g) first sensor means for sensing the initiation of each scanning operation to feed a first sensing signal;

(h) second sensor means for sensing the position of said record sheet on said transfer drum to feed a second sensing signal; and (i) control means responsive to said first and second sensing signals for detecting start and end timings of the transferring of each of said developed original images onto said record sheet and for controlling said transfer drum to rotate at the same speed as said photoconductive drum during the transfer of each developed original image to said record sheet, said control means controlling said transfer drum to rotate during a time interval between the two consecutive transfer operations at such a speed that a leading edge of said record sheet on said transfer drum is brought into agreement with a leading edge of each developed original image on said photoconductive drum.

2. A color copying machine according to claim 1 further comprising tray means for holding record sheets of different sizes and sheet-size selection means for selecting one of the record sheets of different sizes, said sheet-size selection means supplying said selected record sheet to said transfer drum and outputting a sheet-size signal representative of the size of the selected record sheet, said control means further responsive to said sheet size signal for controlling said transfer drum to rotate during said time interval.

3. A color copying machine according to claim 1, wherein said first sensor means is located at the home position of a light source.

4. A color copying machine according to claim 1, wherein said second sensor means photosensor is disposed upstream of the transfer point and adjacent to a peripheral surface of said transfer drum for detecting a trailing edge of the record sheet held by said transfer drum.

* * * * *